US010780315B2

(12) United States Patent
Zhou

(10) Patent No.: US 10,780,315 B2
(45) Date of Patent: Sep. 22, 2020

(54) BODY-BUILDING DEVICE AND FITNESS METHOD

(71) Applicant: ZHEJIANG MARATTI FURNITURE CO., LTD, Zhejiang (CN)

(72) Inventor: Jun Zhou, Zhejiang (CN)

(73) Assignee: ZHEJIANG MARATTI FURNITURE CO., LTD, Zhejiang (CN)

( * ) Notice: Subject to any disclaimer, the term of this patent is extended or adjusted under 35 U.S.C. 154(b) by 116 days.

(21) Appl. No.: 15/896,066

(22) Filed: Feb. 14, 2018

(65) Prior Publication Data

US 2019/0076695 A1 Mar. 14, 2019

(30) Foreign Application Priority Data

Sep. 10, 2017 (CN) ..... 2017 1 0837899
Sep. 10, 2017 (CN) ..... 2017 1 0837900
Dec. 15, 2017 (CN) ..... 2017 1 1345073

(51) Int. Cl.

| | |
|---|---|
| ***A63B 22/06*** | (2006.01) |
| ***A63B 22/18*** | (2006.01) |
| ***A63B 23/04*** | (2006.01) |
| ***A63B 22/20*** | (2006.01) |
| *A63B 22/00* | (2006.01) |
| *A63B 21/16* | (2006.01) |
| *A63B 23/12* | (2006.01) |
| *A63B 23/02* | (2006.01) |
| *A63B 21/055* | (2006.01) |
| *A63B 23/035* | (2006.01) |
| *A63B 21/04* | (2006.01) |

(52) U.S. Cl.

CPC ..... *A63B 22/06* (2013.01); *A63B 22/18* (2013.01); *A63B 22/20* (2013.01); *A63B 23/0458* (2013.01); *A63B 21/0442* (2013.01); *A63B 21/0552* (2013.01); *A63B 21/1609* (2015.10); *A63B 22/0015* (2013.01); *A63B 22/0087* (2013.01); *A63B 23/0211* (2013.01); *A63B 23/0216* (2013.01); *A63B 23/03541* (2013.01); *A63B 23/1236* (2013.01)

(58) Field of Classification Search

None

See application file for complete search history.

(56) References Cited

U.S. PATENT DOCUMENTS 6,709,052 B2 * 3/2004 Jalkanen ..... A47C 9/025 297/202
7,081,075 B2 * 7/2006 Sachs ..... A63B 26/003 482/146

(Continued)

*Primary Examiner* — Joshua Lee
(74) *Attorney, Agent, or Firm* — JCIPRNET

(57) ABSTRACT

A body-building device including a base body, a swing mechanism and a supporter is provided. The base body is used to support the whole body-building device. The swing mechanism is installed on the base body to enable 360-degree rotation in the circumferential direction or swing to any angle off the central axis of the base body. The supporter is installed at an upper end of the swing mechanism and makes direct contact with human body. With force applied by human body, it drives the swing mechanism to rotate or swing, while the swing mechanism generates a corresponding reset force during swing, thus enabling body building. Fitness methods are also provided.

19 Claims, 16 Drawing Sheets

(56) References Cited

U.S. PATENT DOCUMENTS

| | | | | |
|---|---|---|---|---|
| 7,090,628 | B2 * | 8/2006 | Badarneh | A63B 22/16 482/140 |
| 7,175,577 | B2 * | 2/2007 | Greenspan | A61H 1/0237 482/146 |
| 7,374,517 | B2 * | 5/2008 | Lockett | A63B 21/0004 297/271.5 |
| 7,476,188 | B2 * | 1/2009 | Perez, Jr. | A63B 23/0211 472/103 |
| 7,632,218 | B2 * | 12/2009 | Sannes | A63B 22/18 482/146 |
| 8,544,809 | B1 * | 10/2013 | Laurita | A47C 3/18 248/346.01 |
| 9,756,945 | B2 * | 9/2017 | Jenkins | A47C 3/026 |
| 9,788,659 | B1 * | 10/2017 | Jen | A47C 9/002 |
| 10,376,070 | B1 * | 8/2019 | Jen | A47C 9/002 |
| 2005/0029842 | A1 * | 2/2005 | Martin | B62J 1/02 297/199 |
| 2011/0012397 | A1 * | 1/2011 | Wallace | A47C 9/005 297/195.11 |
| 2011/0028290 | A1 * | 2/2011 | Ozawa | A63B 26/003 482/142 |
| 2013/0296147 | A1 * | 11/2013 | Cruz | A63B 26/003 482/146 |
| 2017/0056744 | A1 * | 3/2017 | Cosma | A63B 69/04 |
| 2017/0112287 | A1 * | 4/2017 | Schmitz | A47C 7/029 |
| 2019/0184227 | A1 * | 6/2019 | Gouzenko | A63B 22/16 |

* cited by examiner

BODY-BUILDING DEVICE AND FITNESS METHOD

CROSS-REFERENCE TO RELATED APPLICATION

This application claims the priority benefits of China application no. 201710837899.6, filed on Sep. 10, 2017, China application no. 201710837900.5, filed on Sep. 10, 2017, and China application no. 201711345073.4, filed on Dec. 15, 2017. The entirety of each of the above-mentioned patent applications is hereby incorporated by reference herein and made a part of this specification.

FIELD OF THE INVENTION

This invention relates to the field of body building and health, and more particularly to a body-building device and fitness method.

BACKGROUND ART

In recent years, body-builders have tried various methods to achieve their body-building goals. For instance, people are doing conventional sports by taking their own weight as resistance force (e.g. push-up and sit-up). To meet their fitness requirements, body-builders also make use of cable, pulley, weight, spring, and/or hand-held weight and/or device with elastic rod system.

While recently body-builders have realized the value of the body-building device that places the users on unsteady positions. One similar device is stability ball, also called fitball or Swiss ball.

Stability ball is a big flexible ball generating instability during fitness exercises. When taking exercises, the user develops his/her core muscles to keep balance. For instance, body-builder may practice holding hand weight while lying on the stability ball. Due to the ball's instability, the user is required to stretch and use core muscles to keep balance, while practicing holding hand weight at the same time. Unlike exercising the target muscle groups only, the stability ball user also improves balance and stability with core or stable muscles.

However, stability ball is relatively bulky, therefore it's usually unable to meet the expectations of people who have limited time and space.

SUMMARY OF THE INVENTION

In view of the above-mentioned shortcomings of the prior art, the present invention provides a body-building device that is small-sized and not restricted by space, enabling exercises at anytime and anywhere. This body-building device may generate instability as well during fitness exercises. The body-builder may adopt different fitness methods to improve balance and stability, so as to achieve the aim of exercising core or stable muscles.

The present invention also provides a fitness method based on said body-building device, which is able to meet a variety of fitness requirements such as back muscle stretching, plank, etc., with no restrictions on place.

The present invention is achieved by the following technical solution:

A body-building device comprising:

a base body, which is used to support the whole device;

a swing mechanism, which is installed on the base body to enable 360-degree rotation in the circumferential direction or swing to any angle off the central axis of the base body;

a supporter, which is installed at the upper end of the swing mechanism and makes direct contact with human body. With force applied by human body, it drives the swing mechanism rotate or swing, while the swing mechanism generates corresponding reset force during swing, thus enabling body building.

Comparing to prior art, the benefits of the present invention are:

1. Featuring in novel styling, small size, space-saving and portability, the body-building device in the present invention can increase the user's interest and affection more greatly than ordinary body-building device, therefore to a certain extent increases the frequency of use and extend the duration of body building.

2. Installed on the swing mechanism, the supporter may be used as seat cushion under some circumstances, providing dynamic support and assistance to body-builder's movements, making fitness more effective; meanwhile its 360-degree rotation design enables user to exercise strength, sense of balance and core strength more effectively. During exercises, dynamic support provided by the supporter assists body-builder in exercising the sense of balance, making body-builders quickly control the balance of the body.

When the cushion is in a stable and balanced state, if the body-builder does not have enough strength and sense of balance, his/her arm and body will tremble. Body-builder maintains the sense of balance through long-term exercises.

3. The swing mechanism of the body-building device enables the supporter to rotate in 360 degrees, meanwhile it's able to swing to any angle off the central axis of the base body, therefore it can automatically adapt to the needs of supporting on corresponding parts of human body and changing of sitting postures at any angle, thus making it possible for the user to willfully change the angle and posture. Change of postures can keep corresponding body parts healthy and relaxing instead of being constricted, realizing a more comfortable and healthy use.

4. The body-building device in the present invention may be converted to a seating device by combining with a base which includes support rod or gas lift, turning the supporter into a seat cushion. When sitting on the supporter, the user is in a state of half sitting and half standing, the weight of the upper body mainly borne by the ischium, so the upper torso can stay naturally straight instead of stooping as sitting on conventional seats. Meanwhile, as the present invention is provided with swing function, the user can self-adapt when sitting on it swinging from one side to the other, thus keeping the spine healthy and the body balanced at any angle, in line with the requirements of health. While sitting on it, the user may also perform exercises such as stretching, which is beneficial to human health.

Furthermore, being placed on the ground or stool, the body-building device in the present invention can also be used as an independent seating device for user to sit and rest. It makes up or improves the defect of conventional chair or stool which makes user feel fatigue after prolonged sitting due to poor design. Thanks to the ergonomic design with curved surface, the supporter in the present invention is able to effectively relieve the stress at the pelvis caused by body weight, improve the blood circulation of lower limbs, ease the pressure on shoulder and neck muscles, improve the health of spine and back, and what's more, increase blood and oxygen supply to the brain so to relieve tiredness.

The supporter of the body-building device in the present invention consists of the first and the second support plate that are put together and having rotary connection. The angle between the first and the second support plate is adjustable. Therefore, the shape, size and the frontal projected area onto the ground or horizontal plane of the supporter is changeable, able to meet various requirements of different body types, different sitting postures, different use habits and standing aid, and what's more, to satisfy personal preferences of different users.

DESCRIPTION EMBODIMENTS

Figure 1:
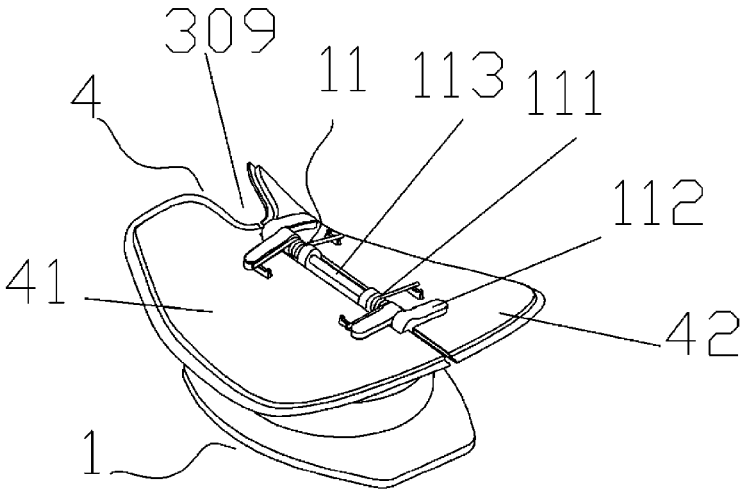
FIG. 1 is a schematic view of the main structure assembly of the body-building device in the present invention.
Figure 2:
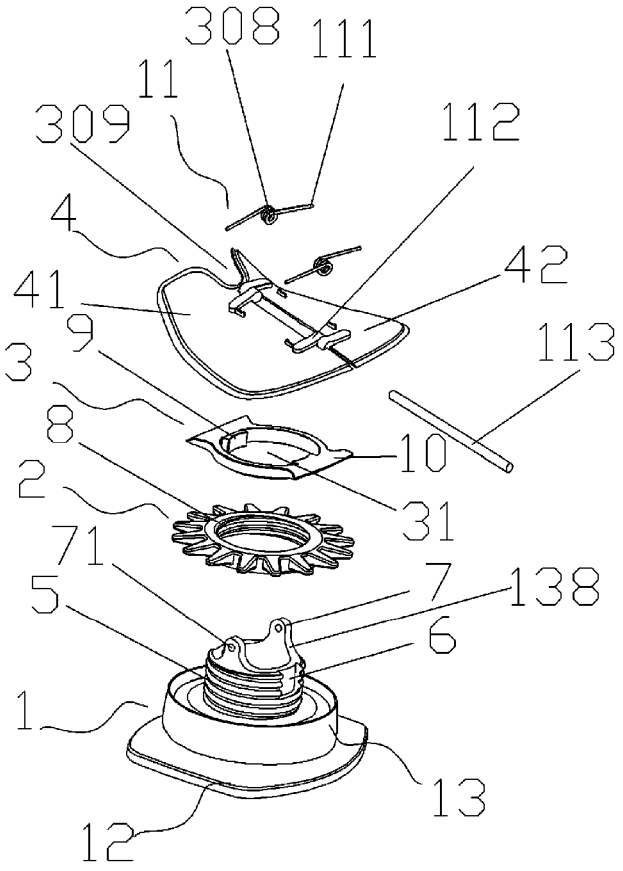
FIG. 2 is a schematic view of the breakdown of the main structure of the body-building device in the present invention.
Figure 3:
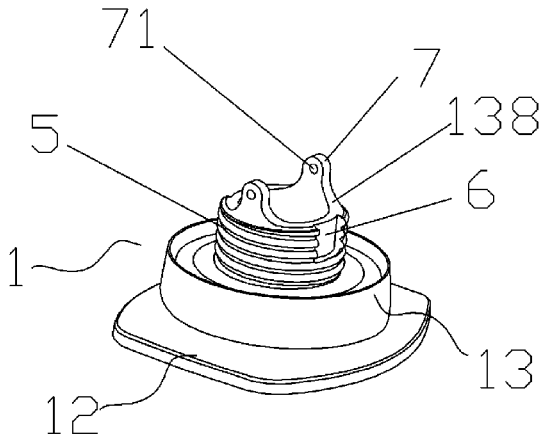
FIG. 3 is a three-dimensional schematic view of the base and the swing mechanism of the body-building device in the present invention.

Below is detailed description of technical solution of the present invention based on drawings and embodiment. It's understood that the components illustrated in the drawings are schematic and not restrictive, drawing not to scale.

First of all, the reference azimuth of the parts of the present invention is defined. The body-building device in the present invention takes the position under normal use as reference, above and below of the body-building device respectively referring to above and below when the central shaft of the body-building device is vertical.

In the embodiment shown in FIG. 1, FIG. 2, FIG. 3 and FIG. 4:

A body-building device in the present embodiment, comprising:

base body 1, installed with height adjusting structure 5, distance adjusting structure 6 and connecting-and-fixing structure 7; the bottom surface of base body 1 is flat;

Turnplate 2, serving as adjusting component co-working with the base body and able to turn up and down along the base; turnplate 2 is installed with position adjusting structure 8 that enables turnplate 2 to move up and down along base 1 and co-works with height adjusting structure 5;

Swing mechanism 13, installed in the middle of base body 1; said swing mechanism 13 includes cylinder 138 which swings as a result of external forces;

Adjusting actuator 3, serving as actuating component moving up and down by co-working with base body 1 and being driven by turnplate 2; adjusting actuator 3 is installed with stop block 9 co-sliding with distance adjusting structure 6; adjusting actuator 3 is installed with tilt support structure 10;

Supporter 4, used to respond to the movements of adjusting actuator 3 to realize the change of the size of its own frontal projected area, is installed above adjusting actuator 3 and connected with cylinder 138; supporter 4 presents a split twin-saddle structure, with each saddle extending outward from the middle and the middle is above both sides. Each saddle surface is inclined forward from the rear middle, forming a transition oblique surface from high to low; when doing single-hand support with the supporter, user's hand holds the middle part of twin saddle, and the holding force and friction force can be increased. Moreover, the shape is matched with human hand grip, which is in line with ergonomics; when sitting on the supporter, forming a 135-degree angle between waist and hip, between thigh and lower leg, the user is in a state of half sitting half standing, the weight of the upper body mainly borne by the ischium, so the upper torso can stay naturally straight instead of stooping as sitting on conventional seats, playing as icing on the cake to body building.

There is an inward notch 309 in the front middle of the supporter; a certain space is maintained between supporter 4 and base body 1, specifically, supporter 4 consists of the first support plate 41 and the second support plate 42 of bilateral symmetry; the first support plate 41 and one side of the second support plate 42 are aligned together with rotary connection, moreover, rotating component 11 is installed between the first support plate 41 and the second support plate 42 to enable angle change between the first support plate 41 and the second support plate 42. The first and second support plate 41, 42 have rotary connection after putting both together, making the angle of the supporter adjustable and adaptive to requirements of different body types; besides, supporter 4 always remain in a state that the middle is above both sides, easy for user to sit and hold which is in line with ergonomics.

Height adjusting structure 5 is external thread formed on cylinder 138. The external thread can be either left-hand thread or right-hand thread.

Distance adjusting structure 6 is a slot symmetrically installed on cylinder 138. The height of the slot in the axial direction of the base body matches the displacement of adjusting actuator 3.

Connecting-and-fixing structure 7 is two symmetrical engaging lugs installed upward from the top of cylinder 138. The engaging lug has connection hole 71.

The position of distance adjusting structure 6 on cylinder 138 and the position of connecting-and-fixing structure 7 on base 1 are cross structured.

Figure 5:
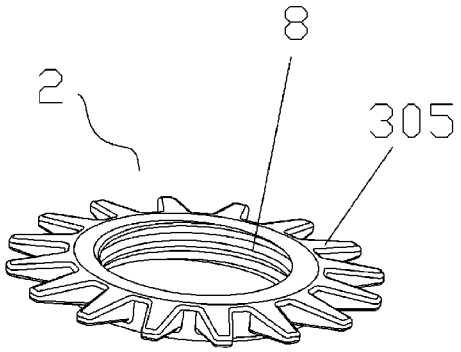
FIG. 5 is a schematic view of the turnplate of the body-building device in the present invention.

Referring to FIG. 5, turnplate 2 is a round plate with gear 305 on the outer ring, thus easy to rotate turnplate 2 at any position; position adjusting structure 8 is internal thread formed in the center hole of the turnplate. The internal thread can be either left-hand thread or right-hand thread.

Figure 6:
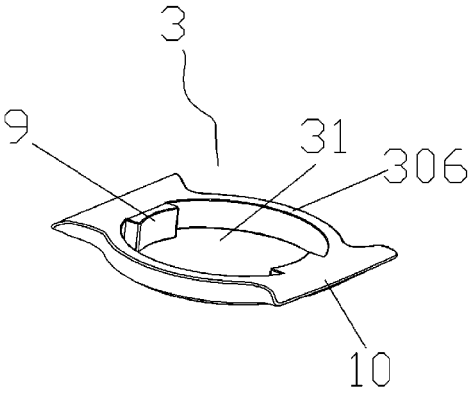
FIG. 6 is a schematic view of the adjusting actuator of the body-building device in the present invention.
Figure 7:
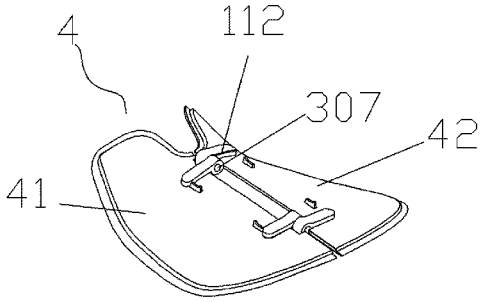
FIG. 7 is a schematic view of the supporter of the body-building device in the present invention.

As illustrated in FIG. 6, adjusting actuator 3 includes ring 306, and ring 306 has central mounting hole 31. Stop block 9 is symmetrically installed on the wall of the central mounting hole, and stop block 9 is located in the slot of cylinder 138; the slot co-works with the stop block, preventing the adjusting actuator from circumferential rotation, allowing up-and-down movements only. Tilt support structure is used to make contact with the first and the second support plate 41 and 42 to change the angle in between.

Said tilt support structure 10 is two rectangular bumps extending outward formed on the outer edge of the ring, wherein the angle between the two rectangular bumps is 180 degrees, and moreover, the upper surface of the rectangular bump is curved surface that makes contact and is matched with the first or the second support plate. Such structure design does not only make it possible for the tilt support structure to lift up the first and the second support plate 41 and 42, but also make the applied force in an upward or oblique upward direction, realizing an effective transfer of force.

Rotating component 11 consists of torsion spring 111, connecting part 112 and axis pin 113. Connecting part 112 shows a foldable structure, connected to the first support plate 41 and the second support plate 42 respectively. There is axle hole 307 at the free end of the connecting part. Torsion spring 111 is designed to have a common axis with axle hole 307 of connecting part 112. Both ends of torsion spring 111 are pressed against the first support plate 41 and the second support plate 42 respectively. Axis pin 113 runs through axle hole 307 of connecting part 112, connection hole 71 of the engaging lug, and central hole 308 of torsion spring 111. The first support plate 41 and the second support plate 42 rotate with axis pin 113 as the axis and reset through rotating component 111. The first and the second support plate 41 and 42 have rotary connection through axis pin. The first and the second support plate 41 and 42 always swerve downward under the effect of torsion spring 111.

By rotating turnplate 2 in one direction, adjusting actuator 3 is moving upward to enlarge the angle between the first and the second support plate; by rotating turnplate 2 in the opposite direction, adjusting actuator 3 is moving downward, making the first and the second support plate reset gradually.

Figure 9:
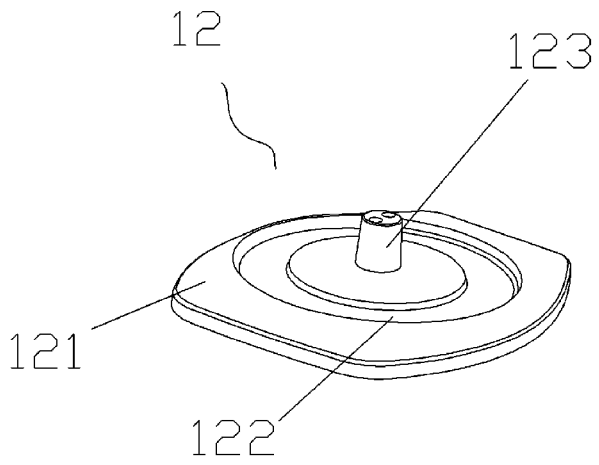
FIG. 9 is a three-dimensional schematic view of the base body of the body-building device in the present invention.

Furthermore, said base body 1 consists of chassis 121 and central shaft 123; said swing mechanism 13 is installed on the central shaft of chassis 121, and there is a circular installation slot 122 in chassis 121 (see FIG. 9).

Central shaft 123 is installed upward in the center of chassis 121. Installation slot 122 is situated in chassis 121 encircling the central shaft.

Figure 8:
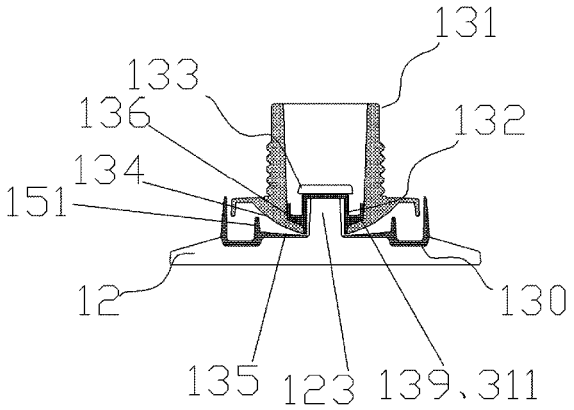
FIG. 8 is a cutaway view of the swing mechanism of the body-building device in the present invention.
Figure 10:
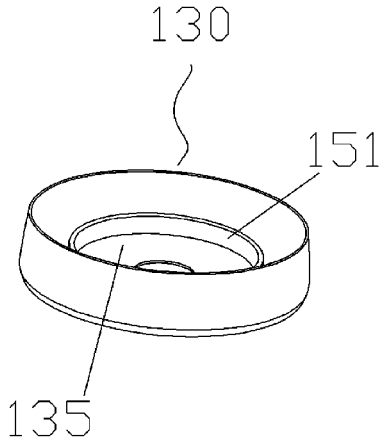
FIG. 10 is a schematic view of the swing base of the body-building device in the present invention.

As illustrated in FIG. 8, swing mechanism 13 consists of (from the bottom up) swing base 130, swing actuating mechanism 131, reset mechanism 132 and fixing member 133, wherein swing actuating mechanism 131 is installed with hemispherical cambered surface 134; referring to FIG. 10, swing base 130 is a soft rubber cover body, and inside swing base 130 there is an arc bottom surface 135; the soft rubber cover body structure of swing base 130 enables 360-degree swing of the swing actuating mechanism, and moreover, it provides safety protection, preventing hands from pinching.

Figure 4:
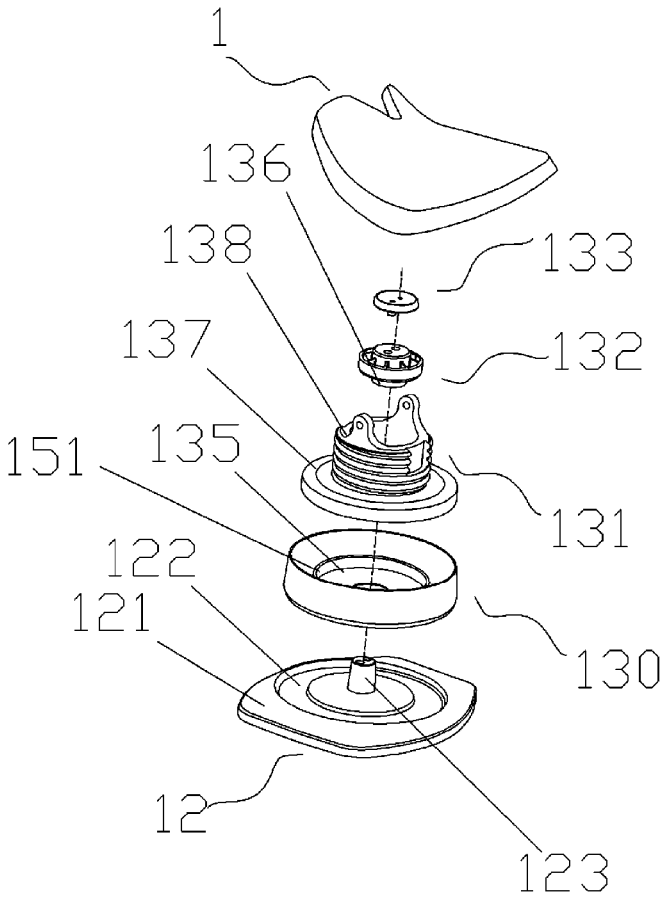
FIG. 4 is a schematic view of the breakdown of the base, the swing mechanism and the supporter of the body-building device in the present invention.

Furthermore, as illustrated in FIGS. 4, 8 and 10, swing base 130 is provided with an upward raised circular edge 151 inside it. Arc bottom surface 135 lies inside the space surrounded by circular edge 151. When the swing amplitude of swing actuating mechanism 131 is too large, circular edge 151 can provide it certain support and certain reset force to keep the whole stable; meanwhile, it hides hemispherical cambered surface 134 inside, making the appearance attractive and preventing hands from crushing.

The radian of hemispherical cambered surface 134 is smaller than that of arc bottom surface 135; the radian of hemispherical cambered surface 134 and that of arc bottom surface 135 are set differently in order to enable 360-degree swing of the swing mechanism in the range of radian difference, bringing more comfort and ease to human body.

The existence of swing base 130 provides certain support to hemispherical cambered surface 134 of the cylinder. Swing base 130 is located in installation slot 122 of chassis 121, hence swing base 130 can be further orientated, without worrying about its displacement.

Reset mechanism 132 is equipped with elastic member 136 to provide swing power for and to realize the reset of swing actuating mechanism 131. Swing actuating mechanism 131 has rotary connection with the central shaft of chassis 121, enabling the supporter and the swing actuating mechanism to rotate in 360 degrees in the circumferential direction.

Figure 11:
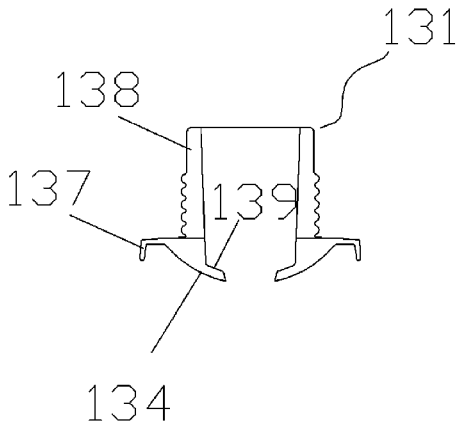
FIG. 11 is a cutaway view of the swing actuating mechanism of the body-building device in the present invention.

Swing actuating mechanism 131 consists of a central plate 137 and a cylinder 138 (see FIG. 11). Cylinder 138 is installed upward on the upper surface of central plate 137 along a common axis with central plate 137. Hemispherical cambered surface 134 is installed downward on the lower surface of central plate 137 along a common axis with central plate 137. Cylinder 138 is hollow inside and capped on central shaft 123. The lower end inside said cylinder 138 shrinks oblique downward to the central shaft, forming inner ring wall 139.

Figure 12:
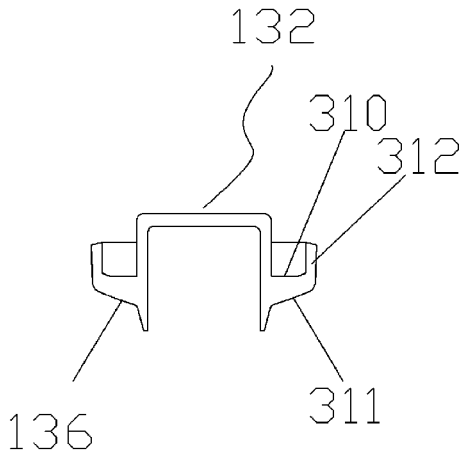
FIG. 12 is a cutaway view of the reset mechanism of the body-building device in the present invention.
Figure 13:
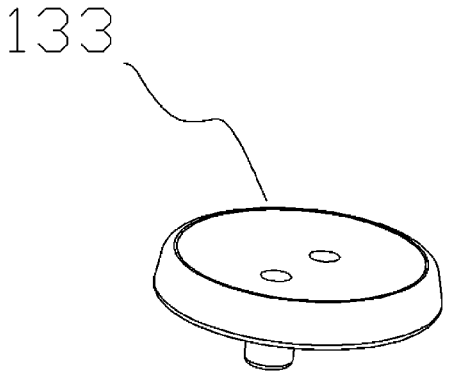
FIG. 13 is a schematic view of the fixing member of the body-building device in the present invention.

Said reset mechanism 132 is equipped with elastic member 136 to provide reset force for the swing actuating mechanism. Said elastic member 136 is capped on central shaft 123, and elastic member 136 is equipped with elastic ring 310 installed in the radial direction. Said elastic ring 310 has outer ring wall 311 which coincides with the shape of inner ring wall 139. As shown in FIG. 12, inner ring wall 139 of the cylinder is in close contact with outer ring wall 311 of elastic ring 310. As shown in FIG. 13, reset mechanism 132 is installed inside cylinder 138 and fixed tightly to base body 1 by fixing member 133. Specifically, elastic member 136 is cap-shaped and capped on central shaft 123, wherein central shaft 123 is equipped with fixing member 133 and fixing member 133 is fixed on the top of central shaft 123 by screw.

To ensure adequate support and elastic feedback, the outer edge of elastic ring 310 extends upward to form a convex ring 312. Said convex ring 312 makes contact with the lower part of the cylinder's inner wall. When the force is transferred to cylinder 138 from the supporter, cylinder 138 swings, and elastic ring 310 of the elastic member is intruded by inner ring wall 139, wherein the deformation of elastic ring 310 provides reset force for cylinder 138.

Both central plate 137 and cylinder 138 are made of hard material, with metal preferred, while elastic member 136 is made of soft rubber or plastic, which ensures a certain swing range of cylinder 138.

Detailed installation procedure as below: first of all, mount the swing mechanism to the central shaft of the chassis, and mount reset mechanism 132 to the central shaft as well in contact with the inner wall of the swing actuating mechanism, then fix the fixing member to the central shaft with screw; install the turnplate onto cylinder 138 of swing actuating mechanism 131 through screw threads, wherein when the turnplate rotates from side to side, it will move up and down at the center point of the base due to the effect of screw threads, whether it moves up or down depending on the rotation direction of the screw threads. Then install adjusting actuator 3 to cylinder 138 of swing actuating mechanism 131. Stop block 9 of the adjusting actuator fits perfectly into the slot of the cylinder of swing actuating mechanism 131. Adjusting actuator 3 can only move up and down within the range of movement of the slot through stop block 9.

Axis pin 113 runs through axle hole 307 of connecting part 112, connection hole 71 of the engaging lug, and central hole 308 of torsion spring 111, connecting the cylinder and the supporter as a whole. The supporter is wrapped or fitted with cushion or leather sponge, thus becoming a complete body-building device.

Figure 14:
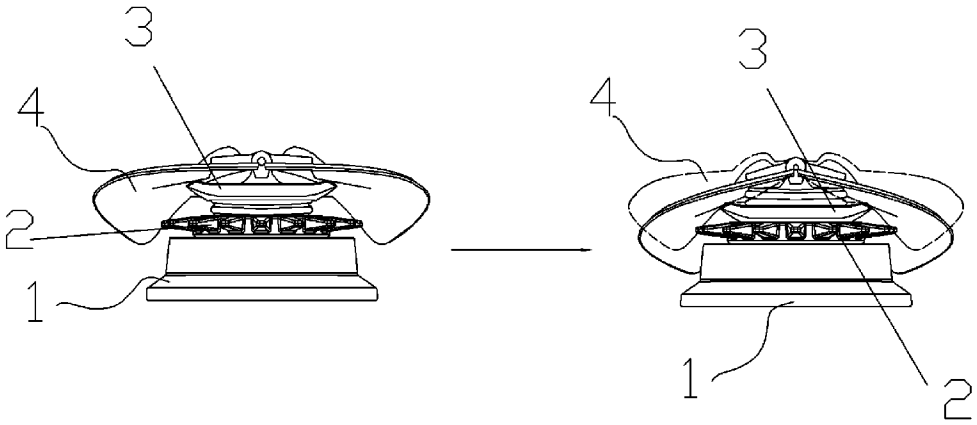
FIG. 14 is a schematic view of the change process of the angle between the first support plate and the second support plate of the body-building device in the present invention.

As shown in FIG. 14, by rotating the turnplate left and right, the turnplate moves up and down on swing actuating mechanism 131 of the base. The distance between the upper and lower movements is controlled by the slot. If the turnplate rotates to the left, the adjusting actuator moves upward. While the adjusting actuator moves upward, the bottom of the first support plate and the second support plate is pushed upward by tilt support structure 10 at both ends of the adjusting actuator. As the middle of the first support plate and the second support plate is fixed on the engaging lug by axis pin, when the bottom of the first support plate and the second support plate is pushed upward by the adjusting actuator, the middle of the supporter remains unmoved while the angle between the first support plate and the second support plate on the left and right sides of the supporter changes with the up-and-down movements of the adjusting actuator. When the angle of the supporter becomes larger up, the orthographic projection area of the supporter on the ground enlarges, while the dimension of the supporter reduces when the angle becomes smaller, thus realizing the adjustment of the angle between the first and second support plates and making the body-building device satisfy the needs of different people. To increase the level of comfort, the surface of the supporter is also wrapped with sponge and fabric.

Figure 15:
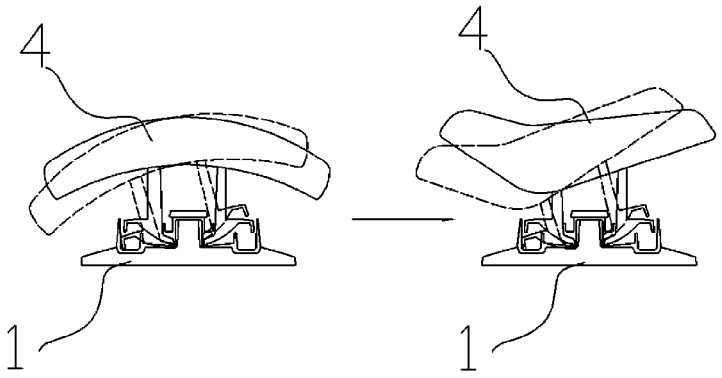
FIG. 15 is a schematic view of the swing process of the swing mechanism of the body-building device in the present invention.

As illustrated in FIG. 15, this body-building device is able to automatically adapt to the sitting posture of human body by 360-degree movement and change to any angle, thus realizing 360-degree free adjustment of angles.

Swing base 130 is arranged in the shape of a shield. Inside the swing base it's provided with arc bottom surface 135 matched with hemispherical cambered surface 134 of swing actuating mechanism 131. Swing base 130 is injection molded with soft rubber. Swing base 130 also functions as a soft rubber barrel preventing hands from pinching. The base body and swing base 130 can also be set as a whole.

The hemispherical cambered surface of swing actuating mechanism 131 is matched with arc bottom surface 135 inside swing base 130. The inner ring wall inside swing actuating mechanism 131 is matched with the outer ring wall of reset mechanism 132. Reset mechanism 132 is a soft rubber elastic sleeve. There are two fixed holes in reset mechanism 132 to fit with the mounting holes in the central shaft of the base body.

Fixing member 133 is a fixing plate, in which there are two columnar screw mounting holes used to fix reset mechanism 132 on the central shaft. Placing all components from top to bottom in order, the cylindrical mounting hole in fixing member 133 is threaded through the fixed hole in reset mechanism 132 to the mounting hole on the central shaft with screw so that the whole swing mechanism is connected as a whole. The supporter is screwed to swing actuating mechanism 131, thus completing the assembly of the entire body-building device.

As shown in FIG. 15, the radian of hemispherical cambered surface 134 of swing actuating mechanism 131 is different from that of arc bottom surface 135 inside the swing base. The radian of hemispherical cambered surface 134 is smaller than that of arc bottom surface 135. Both the swing base and the swing actuating mechanism are mounted on the central shaft of the base body, and the central shaft is the center for both of them. Swing actuating mechanism 131 swings in 360 degrees in the range of radian difference between hemispherical cambered surface 134 and arc bottom surface 135. Reset mechanism 132 as a soft rubber elastic sleeve is also installed on the central shaft. The upper end of reset mechanism 132 is fixed to the upper end of the central shaft by fixing member 133. The outer wall of reset mechanism 132 fits perfectly with the inner wall of swing actuating mechanism 131. When swing actuating mechanism 131 swings with the central shaft, the inner wall of swing actuating mechanism 131 compresses the outer wall of reset mechanism 132. Reset mechanism 132 is made of soft rubber which is very elastic. When swing actuating mechanism 131 swings, reset mechanism 132 turns into an elastic device and provides power to the swing and reset of swing actuating mechanism 131.

Furthermore, if the user sits on the supporter, the seat cushion will move freely in 360 degrees with the change of sitting postures back and forth or left and right, automatically adapting to the change of any angle of human sitting posture.

Figure 16:
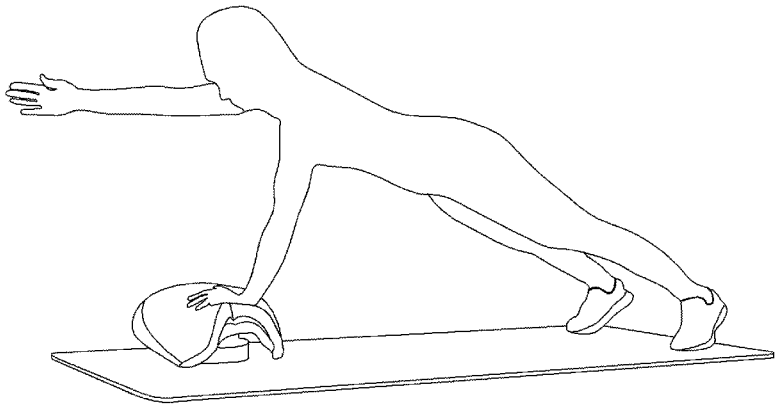
FIGS. 16-24 are various application scene diagrams of using the body-building device in the present invention.

The fitness methods based on said body-building device include but not limited to any of the following A-J actions:

A. As shown in FIG. 16, with the body-building device placed on the ground, the user takes a prone position, both tiptoes touching the ground; arms upright, one hand is supported on the supporter of the body-building device, while the other hand is raised forward. Both hands repeat the above action alternately. In this way, the abdominal muscle groups, the back muscle groups and the shoulder muscle groups of human body can be exercised.

B. Similarly, with the body-building device placed on the ground, the user takes a prone position, both tiptoes touching the ground; both arms bent, the elbows of both arms and the upper arms are supported on the supporter of the body-building device. Hold the position for a predetermined duration and above. In this way, the abdominal muscle groups of human body can be exercised.

Figure 18:
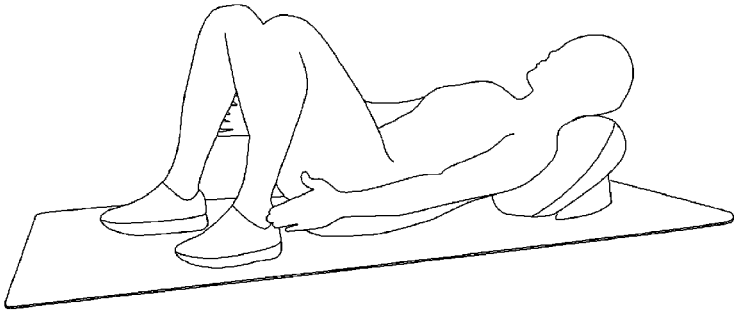

C. As shown in FIG. 18, with the body-building device placed on the ground, the user lies down on the ground, his/her head and back resting on the supporter. Both legs bent, the soles touching the ground, the waist and the hips are lifted intermittently for a predetermined number of times and above. In this way, the buttocks muscle groups and leg muscle groups of human body can be exercised.

Figure 20:
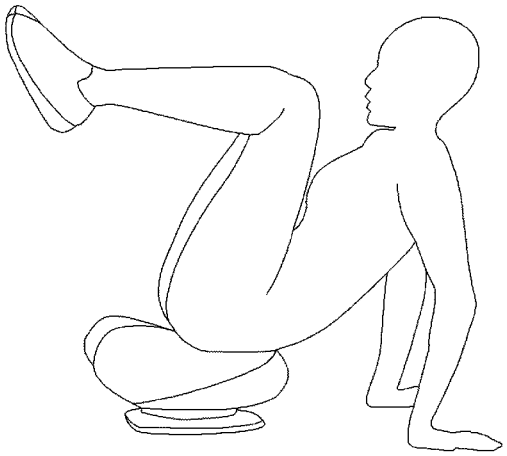

D. As shown in FIG. 20, with the body-building device placed on the ground, the user sits on the supporter, both hands propped back to the ground, both legs bent, while raising the lower legs and then putting down. Repeat the above actions for a predetermined number of times and above. In this way, the abdominal muscle groups of human body can be exercised.

Figure 21:
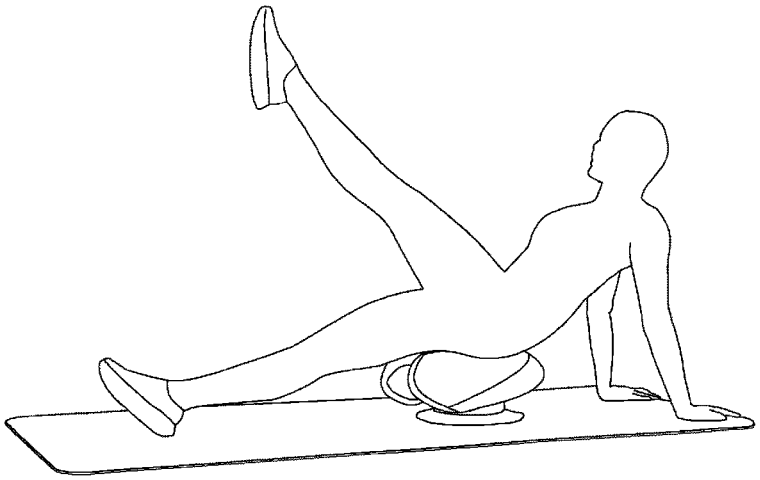

E. As shown in FIG. 21, with the body-building device placed on the ground, the user sits on the supporter, both hands propped back to the ground, both legs stretching straight forward, while raising the legs alternately. Repeat the above actions for a predetermined number of times and above. In this way, the abdominal muscle groups and leg muscle groups of human body can be exercised.

Figure 22:
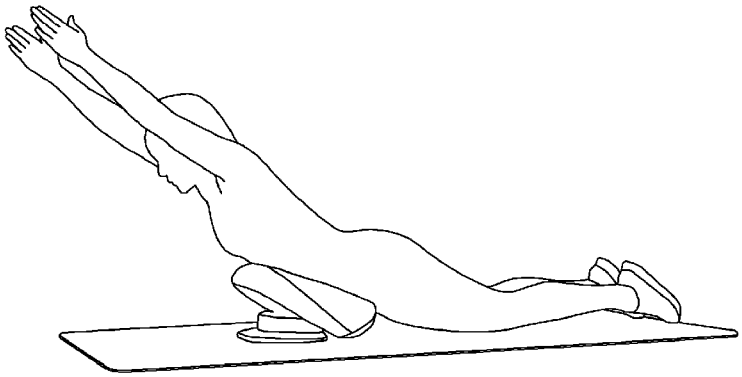

F. As shown in FIG. 22, with the body-building device placed on the ground, the user takes a prone position, both tiptoes and knees touching the ground, and the abdomen attached to the supporter; arms stretching forward, the upper body is raised and lowered at the same time as the arm. Repeat the above actions for a predetermined number of times and above. In this way, the waist and back muscle groups of human body can be exercised.

Figure 24:
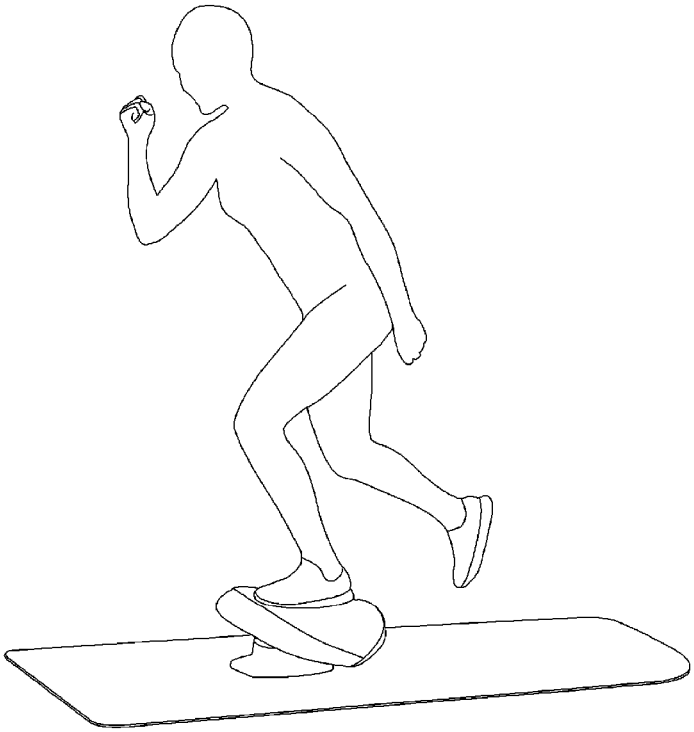

G. As shown in FIG. 24, with the body-building device placed on the ground, the user takes the starting position, both feet alternately pedaling on the supporter, while the arms alternately bending up. Repeat the above actions for a predetermined number of times and above. In this way, the leg muscle groups of human body can be exercised.

Figure 17:
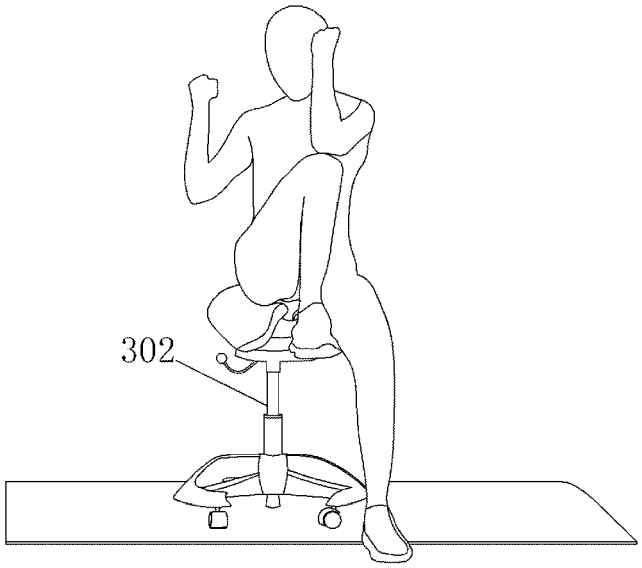

H. As shown in FIG. 17, with the body-building device placed on a vertical upright support rod 302, 60-100 cm off ground, the user sits on the supporter, both legs bending and alternately lifting, while both arms twisting and lifting at the same time, and the upper body twisting to the direction of lifted leg. Repeat the above actions for a predetermined number of times and above. In this way, the abdominal muscle groups of human body can be exercised.

Figure 19:
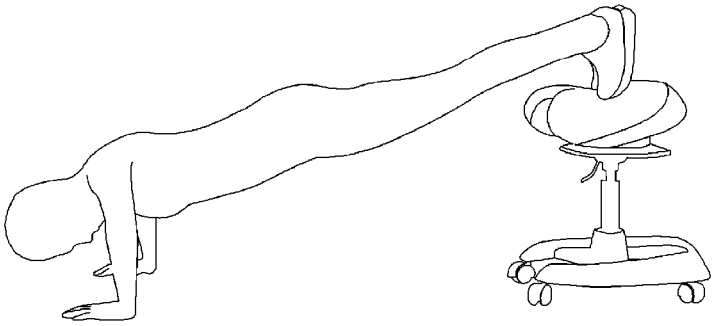

I. As shown in FIG. 19, with the body-building device placed on a vertical upright support rod, 60-100 cm off ground, the user takes a prone position, both tiptoes touching the supporter, the body stretched and both arms supported on the ground. Remain motionless for a predetermined time and above, or do push-ups for a predetermined number of times and above. In this way, the hand muscle groups, the chest muscle groups and the abdominal muscle groups of human body can be exercised.

Figure 23:
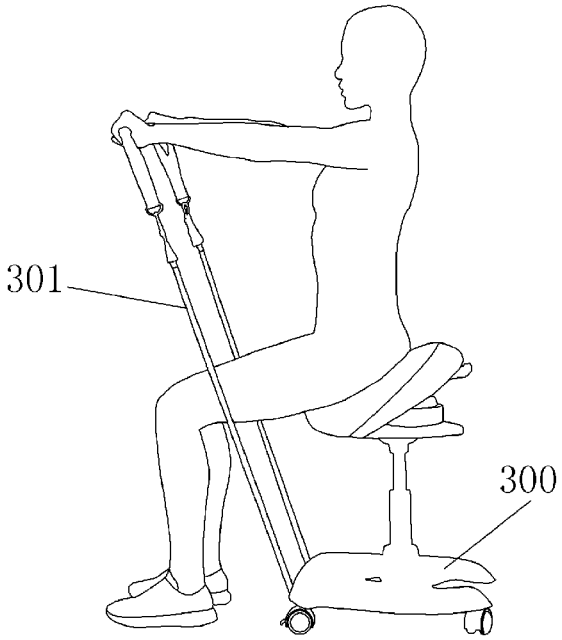

J. As shown in FIG. 23, with the body-building device placed on a support rod with a support foot 300, 60-100 cm off ground, the user sits on the supporter, passing an elastic rope 301 through the support foot, both legs bending and feet touching the ground, meanwhile both hands holding both ends of the elastic ropes respectively and pulling in all directions. Repeat the above pulling actions for a predetermined number of times and above. In this way, the shoulder muscle groups of human body can be exercised.

What is claimed is:

1. A body-building device comprising:

a base body (1), which is used to support the whole body-building device;

a swing mechanism (13), which is installed on the base body (1) to enable 360-degree rotation in a circumferential direction around a central axis of the base body; and a supporter (4), which is installed at an upper end of the swing mechanism (13) and is configured to make direct contact with a human body; with a force applied by the human body, the supporter drives the swing mechanism (13) to rotate or swing, while the swing mechanism (13) generates a corresponding reset force, thus enabling body building, wherein the supporter (4) presents a split twin-saddle structure consisting of a first support plate (41) and a second support plate (42) of bilateral symmetry, with each saddle extending outward from a middle and the middle being above both saddles, each saddle surface is inclined downward from a rear middle toward a front, forming a transition oblique surface from high to low, wherein the first support plate (41) and the second support plate (42) are rotatably connected, wherein an angle between the first support plate and the second support plate is adjustable.

2. The body-building device as claimed in claim 1, wherein an inward notch (309) is in a front middle of the supporter (4).

3. The body-building device as claimed in claim 1, wherein said base body (1) consists of a chassis (121) and a central shaft (123); said swing mechanism (13) is installed on the central shaft (123) of the chassis; said swing mechanism (13), from the bottom up, consists of a swing actuating mechanism (131), a reset mechanism (132) and a fixing member (133); the swing actuating mechanism (131) has a rotary connection with the central shaft (123) of the chassis (121); said fixing member (133) restricts the reset mechanism (132) and the swing actuating mechanism (131) to the central shaft (123).

4. The body-building device as claimed in claim 3, wherein said swing actuating mechanism (131) consists of a central plate (137) and a cylinder (138), said cylinder (138) is installed upward on an upper surface of the central plate (137) along a common axis with the central plate, the cylinder (138) is hollow inside and capped on the central shaft, a lower end inside said cylinder (138) shrinks oblique downward to the central shaft (123), forming an inner ring wall, said reset mechanism (132) is equipped with an elastic member (136) to provide a reset force for the swing actuating mechanism (131), the elastic member (136) is capped on the central shaft (123), and the elastic member (136) is equipped with an elastic ring (310) installed in the radial direction, said elastic ring (310) has an outer ring wall (311) which coincides with a shape of an inner ring wall (139), the inner ring wall (139) of the cylinder (138) is in close contact with the outer ring wall (311) of the elastic ring (310).

5. The body-building device as claimed in claim 4, wherein an outer edge of the elastic ring (310) extends upward to form a convex ring (312), said convex ring (312) makes contact with the lower part of the inner wall of the cylinder (138).

6. The body-building device as claimed in claim 4, wherein both the central plate (137) and the cylinder (138) are made of hard material.

7. The body-building device as claimed in claim 4, wherein said elastic member (136) is fixed tightly to the central shaft (123) of the base body (1) by the fixing member (133).

8. The body-building device as claimed in claim 4, wherein the body: building device further comprises a swing base (130) and the swing base (130) is located between the swing actuating mechanism (131) and the chassis (121), the bottom of said cylinder (138) forms a downward protruding hemispherical cambered surface (134), an arc bottom surface (135) is installed inside said swing base (130) to coincide with the hemispherical cambered surface (134).

9. The body-building device as claimed in claim 4, wherein said central shaft (123) is installed upward in the center of the chassis (121), an installation slot (122) is situated in the chassis (121) encircling the central shaft, the swing base (130) is situated inside the installation slot (122).

10. The body-building device as claimed in claim 8, wherein the radian of said hemispherical cambered surface (134) is smaller than that of the arc bottom surface (135).

11. The body-building device as claimed in claim 8, wherein said swing base (130) is a soft rubber cover body, and an arc bottom surface is inside the swing base (130).

12. The body-building device as claimed in claim 11, wherein the swing base (130) is provided with an upward raised circular edge inside it, the arc bottom surface (135) lies inside the space surrounded by the circular edge.

13. The body-building device as claimed in claim 1, wherein said swing mechanism (13) includes a cylinder (138) which swings under external force, the first support plate (41) and the second support plate (42) arc rotatably connected with the top of the cylinder (138) through a rotating component, the supporter (4) always remaining in a state where the middle is above both sides under the effect of the rotating component.

14. The body-building device as claimed in claim 13, wherein said rotating component consists of a torsion spring (111), an axis pin (113) and a plurality of connecting parts, said connecting parts are connected to the first support plate (41) and the second support plate (42) respectively, an axle hole (307) is at the free end of the connecting part, and two engaging lugs with connection holes at the top of the cylinder (138), said axis pin (113) runs through the axle hole (307) of the connecting parts, a connection hole (71) of the engaging lug, and a central hole (308) of the torsion spring, both ends of the torsion spring (111) are pressed against the first support plate (41) and the second support plate (42) respectively, the first support plate (41) and the second support plate (42) rotate with the axis pin (113) and reset through the rotating component.

15. The body-building device as claimed in claim 13, wherein the body-building device further comprises a turnplate (2) and an adjusting actuator (3) used to adjust the angle between the first support plate (41) and the second support plate (42), wherein external threads are formed on the outer side of the cylinder (138), and said turnplate (2) is capped on the cylinder (138) and connected to the cylinder (138) through screw threads; wherein the adjusting actuator (3) is located between the turnplate and the supporter, the adjusting actuator is slides up and down with the cylinder (138), wherein by rotating the turnplate (2) in one direction, the adjusting actuator (3) moves upward to enlarge the angle between the first support plate (41) and the second support plate (42); wherein by rotating the turnplate (2) in the opposite direction, the adjusting actuator (3) moves downward, making the first support plate (41) and the second support plate (42) reset gradually.

16. The body-building device as claimed in claim 15, wherein a slot is on the outer side of the cylinder, the adjusting actuator includes a ring (306), and said ring (306) is capped on the cylinder, a stop block (9) is installed on an inner edge of the ring (306) to co-slide with the slot, a tilt support structure (10) is formed on an outer edge of the ring (306) used to change the angle between the first support plate (41) and the second support plate (42).

17. The body-building device as claimed in claim 16, wherein said tilt support structure (10) is two rectangular bumps extending outward formed on the outer edge of the ring, wherein the angle between the two rectangular bumps is 180 degrees, and moreover, an upper surface of the rectangular bump is a curved surface that makes contact and is matched with the first support plate (41) and the second support plate (42).

18. The body-building device as claimed in claim 15, wherein a plurality of gears radiates in circumferential direction on said turnplate.

19. Fitness methods based on the body-building device as claimed in claim 1, wherein methods comprise any of the following actions:

(A) with the body-building device placed on the ground, the user takes a prone position, both tiptoes touching the ground, arms upright, one hand is supported on the supporter (4) of the body-building device, while the other hand is raised forward, and repeats the actions in (A) alternately with both hands alternately;

(B) with the body-building device placed on the ground, the user takes a prone position, both tiptoes touching the ground, both arms bent, the elbows of both arms and the upper arms are supported on the supporter (4) of the body-building device, and hold the position for a predetermined duration or more than the predetermined duration;

(C) with the body-building device placed on the ground, the user lies down on the ground, his/her head and back resting on the supporter (4), both legs bent, the soles touching the ground, and the waist and the hips are lifted intermittently for a predetermined number of times or more than the predetermined number of times;

(D) with the body-building device placed on the ground, the user sits on the supporter (4), both hands propped back to the ground, both legs bent, while raising the lower legs and then putting down, and repeat actions in (D) for a predetermined number of times or more than the predetermined number of times;

(E) with the body-building device placed on the ground, the user sits on the supporter (4), both hands propped back to the ground, both legs stretching straight forward, while raising the legs alternately, and repeat in (E) for a predetermined number of times or more than the predetermined number of times;

(F) with the body-building device placed on the ground, the user takes a prone position, both tiptoes and knees touching the ground, and the abdomen attached to the supporter (4); arms stretching forward, the upper body is raised and lowered at the same time as the arm, and repeat actions in (F) for a predetermined number of times or more than the predetermined number of times;

(G) with the body-building device placed on the ground, the user takes the starting position, both feet alternately pedaling on the supporter (4), while the arms alternately bending up, and repeat actions in (G) for a predetermined number of times or more than the predetermined number of times;

(H) with the body-building device placed on a vertical upright support rod, 60-100 cm off ground, the user sits on the supporter (4), both legs bending and alternately lifting, while both arms twisting and lifting at the same time, and the upper body twisting to the direction of lifted leg, and repeat actions in (H) for a predetermined number of times or more than the predetermined number of times;

(I) with the body-building device placed on a vertical upright support rod, 60-100 cm off ground, the user takes a prone position, both tiptoes touching the supporter (4), the body stretched and both arms supported on the ground, and remain motionless for a predetermined time and above, or do push-ups for a predetermined number of times or more than the predetermined number of times; and (J) with the body-building device placed on a support rod with a support foot, 60-100 cm off ground, the user sits on the supporter (4), passing an elastic rope through the support foot, both legs bending and feet touching the ground, meanwhile both hands holding both ends of the elastic rope respectively and pulling in all directions, and repeat the above pulling actions for a predetermined number of times or more than the predetermined number of times.

* * * * *